United States Patent [19]

Schmidt

[11] Patent Number: 4,574,884

[45] Date of Patent: Mar. 11, 1986

[54] DRAINHOLE AND DOWNHOLE HOT FLUID GENERATION OIL RECOVERY METHOD

[75] Inventor: Joseph H. Schmidt, Dallas, Tex.

[73] Assignee: Atlantic Richfield Company, Los Angeles, Calif.

[21] Appl. No.: 652,556

[22] Filed: Sep. 20, 1984

[51] Int. Cl.[4] ..... E21B 43/24

[52] U.S. Cl. ..... 166/263; 166/50; 166/272; 166/901

[58] Field of Search ..... 166/50, 59, 263, 272, 166/303, DIG. 1

[56] References Cited

U.S. PATENT DOCUMENTS

| | | | |
|---|---|---|---|
| 2,584,606 | 2/1962 | Merriam et al. | 166/59 X |
| 3,259,186 | 7/1966 | Dietz | 166/263 |
| 3,439,742 | 4/1969 | Durie | 166/272 |
| 3,441,083 | 4/1969 | Fitzgerald | 166/263 X |
| 3,456,721 | 7/1969 | Smith | 166/59 |
| 3,581,822 | 6/1971 | Cornelius | 166/263 |
| 4,022,279 | 5/1977 | Driver | 166/52 X |
| 4,160,481 | 7/1979 | Turk et al. | 166/50 X |
| 4,249,604 | 2/1981 | Frazier | 166/263 |
| 4,459,101 | 7/1984 | Doherty | 166/59 X |

FOREIGN PATENT DOCUMENTS

| | | | |
|---|---|---|---|
| 911889 | 11/1962 | United Kingdom | 166/263 |

*Primary Examiner*—George A. Suchfield

[57] ABSTRACT

Viscous oil is recovered by a process that increases sweep efficiency and heat and fuel utilization and that reduces well and compression requirements and costs. Initially, fluid pressure communication is created between two horizontal drainhole wells in a manner such that oil is produced during at least a part of the step of creating fluid pressure communication between the wells. Fluid pressure communication may be created by practicing hot aqueous fluid (preferably, steam) huff and puff techniques in one or both of the wells. After fluid pressure communication is created, a combustion supporting gas (probably, air), a fuel (preferably, natural gas) and an aqueous fluid are injected into one of the drainhole wells. The fuel is burned downhole in a manner such that hot aqueous fluid (preferably, steam) is formed. The hot aqueous fluid and hot products of combustion are passed directly into the formation in horizontal line drive fashion. These hot fluids follow a horizontally wide sweep pattern which increases heat transfer to the inplace oil and increases oil drainage into the producing well. The process is especially useful in permafrost areas.

20 Claims, 1 Drawing Figure

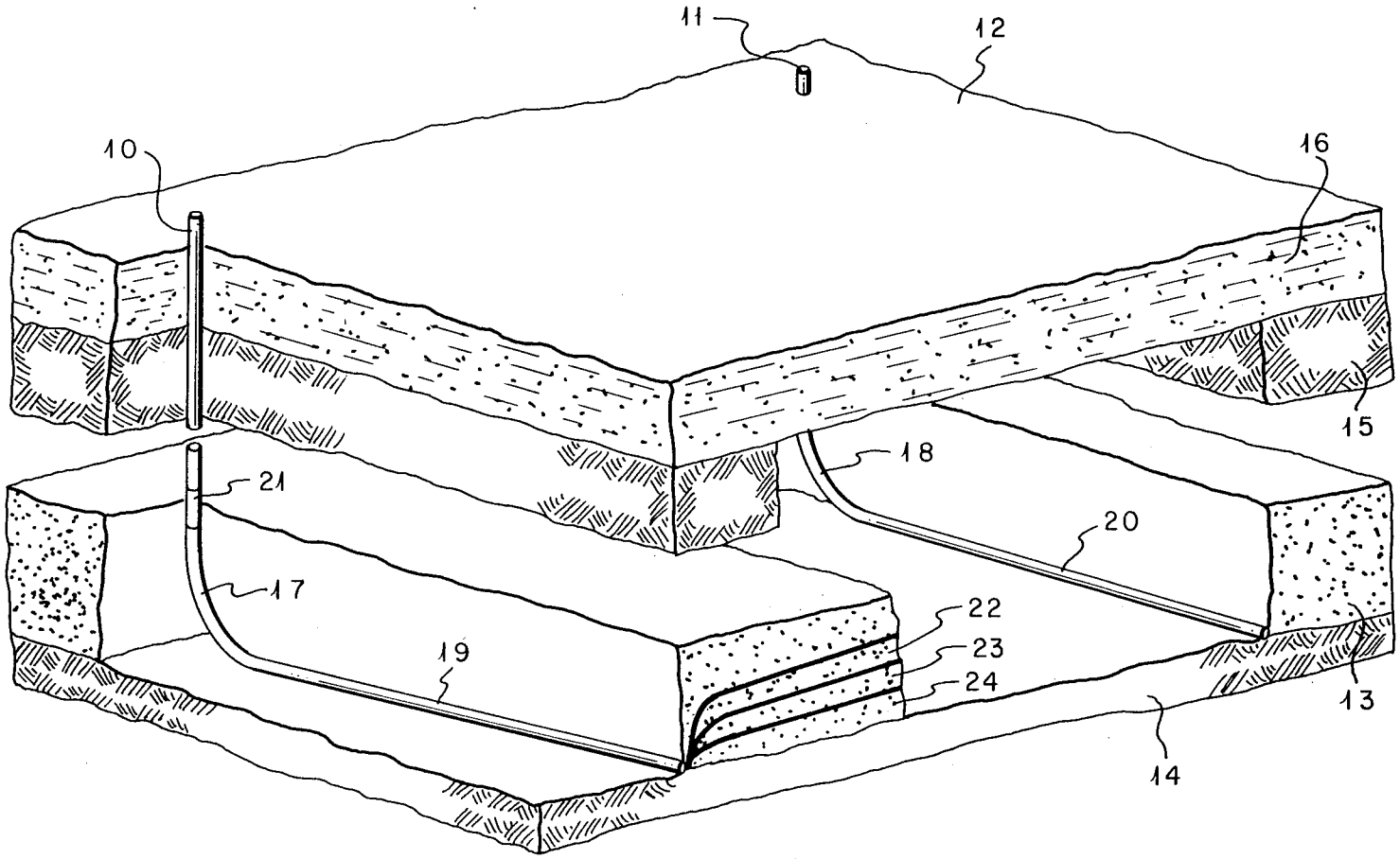
10
11
12
13
14
15
16
17
18
19
20
21
22
23
24

DRAINHOLE AND DOWNHOLE HOT FLUID GENERATION OIL RECOVERY METHOD

BACKGROUND OF THE INVENTION

The present invention combines known techniques for stimulating oil recovery in a manner such that viscous oil recovery is increased and made economical. More particularly, viscous oil is recovered from a subterranean formation by means of downhole burning of fuel and hot fluid generation, passing the steam and products of combustion directly into the formation and creating line drive between horizontal drainholes.

In the recovery of oil from viscous oil-bearing formations, it is usually possible to produce only a very small portion of the original in place oil by natural or primary production. A wide variety of artificial recovery techniques, therefore, have been suggested for increasing oil recovery from these formations. For example, it has been proposed to inject gases into the formation to maintain the pressure of the formation and to decrease in a slight manner the viscosity of viscous oil adjacent the gas.

It has also been proposed to use steam stimulation for increasing oil production. Steam stimulation is the addition of thermal energy to a subsurface reservoir by injection of steam, usually of 60 to 90 percent quality. Steam injection has been practiced primarily as steam drive and as steam huff and puff. These techniques have been carried out with and without foaming, surfactant and caustic agents. In the steam huff and puff process, steam is injected into the formation for a period of time. Thereafter, injection is ceased and the well is backflowed, usually by pumping, to produce fluids from the formation. In one variation, the injection step is followed by a period of shut-in prior to producing fluids from the formation. This variation is called steam soaking. In general, steam is injected into the subsurface formation in quantities sufficient to heat a predetermined distance of the formation radially from the wellbore. This distance changes with time and with the number of huff and puff steps performed. Pressures commonly range between 500 and 2500 psi dependent upon the depth of the formation and the permeability of the formation. The steam is injected at a predetermined rate usually stated in pounds per hour or barrels per day of cold water equivalent, and may be injected for periods of a few days to six months and longer depending on the stage of production. In steam huff and puff (including steam soak), the total volume of reservoir heated is not large. Huff and puff through vertical wells is inefficient in formations of very low mobility and permeability. Huff and puff techniques through vertical wells are significantly limited and in many formations are not adequate for producing much of the oil in place.

It has been proposed to inject steam to drive oil toward a vertical production well. The steam displacing fluid travels from the injection well to the production well. The oil within the steam path is the only part of the oil that is produced. The shape of the path of the steam is called the sweep pattern. For vertical wells, at best the steam travels from the injection point to the production point. The steam sweeps a curvilinear path that resembles a pointed ellipse. The volume of the swept area divided by the total volume is called the sweep efficiency. Practical operations require good sweep sweep efficiency. Sweep efficiency or the height and minor axis of the pointed elliptically shaped sweep pattern is dependent on a number of factors. Two factors are the mobility of the oil and the relative mobilities of the oil and steam. Other factors are the distance between the injection well and the producing well and the nature of the wells. The oil or petroleum in most relatively shallow viscous oil bearing formations is immobile until heated. The relative mobilities, densities and other factors cause the steam to override the oil, thereby decreasing the height of the the curvilinear sweep pattern. The mobility of the oil is so low that the minor axis of the pointed elliptically shaped steam path is small and the sweep pattern looks like a sliver or thickened line between the injection point and production point. Premature steam break through occurs and the steam does not lose its heat to the inplace oil. Moreover, the sweep efficiency is very poor. To improve sweep efficiency it has been proposed to drill a line of vertical injection wells and a laterally spaced line of vertical production wells and use a form of displacement called line drive. For line drive between vertical wells the number and costs of the wells required to accomplish the effects of line drive are excessive in viscous oil bearing formations.

In U.S. Pat. No. 3,960,214, it has been proposed to drill a horizontal drainhole in a viscous oil-bearing formation and to drill vertical production wells above and along the length of the horizontal injection well. This process is inefficient. The mobilized viscous oil tends to drain toward the lower part of the formation and the cost of the vertical production wells is excessive. The steam tends to channel through the oil and the sweep effiency is low.

The steam for steam stimulation is usually generated at the surface of the earth and injected through an injection well from the surface. In U.S. Pat. No. 3,456,721, it has been proposed to use a downhole burner apparatus for generating the steam. A fuel is burned downhole with air and water is injected to contact and heat exchange with the flame to turn water into steam. Downhole steam generation has several advantages. The hot exhaust gases are coinjected with the steam into the reservoir as opposed to conventional steam generators which exhaust to the atmosphere. Additionally, the exhaust gases maintain the formation pressure and add a certain amount of viscosity reduction to the oil. Adverse environmental effects on air quality are also reduced.

Some of the more extensive and valuable viscous oilbearing formations are found in areas covered by permafrost. Use of heat through an injection well creates problems in permafrost areas by thawing the area around the injection well.

It is an object of this invention to combine such known techniques in a manner such that many of the above-cited defficiencies associated with the known techniques and vertical wells are avoided or reduced. It is a further object of this invention to provide a viscous oil recovery process that is particularly useful and economical for remote areas, especially the remote areas of Alaska and similar areas where there is permafrost. It is still another object of the invention to provide a process wherein oil is economically produced during the first stage of the process.

SUMMARY OF THE INVENTION

This invention provides a process for recovering viscous oil from a subsurface formation. In the process, sweep efficiency and heat and fuel utilization are increased and well and compression requirements and costs are reduced. In the first stage of the process, fluid pressure communication is created between two horizontal drainhole wells in a manner such that oil is produced during at least a part of the step of creating fluid pressure communication between the wells. Fluid pressure communication may be created by practicing hot aqueous fluid (steam, hot water, or mixtures thereof) huff and puff techniques in one or both of the wells. After fluid pressure communication is created, a combustion supporting gas (for example, air), a fuel (for example, natural gas) and an aqueous fluid are injected into one of the drainhole wells. The fuel is burned downhole in a manner such that hot aqueous fluid (steam/hot water) is formed downhole. The hot aqueous fluid and hot products of combustion are passed directly into the formation in horizontal line drive fashion from the injection well toward a producing second well. These hot fluids follow a horizontally wide sweep pattern which increases heat transfer to the inplace oil and increases gravity oil drainage into the producing well. The process of this invention requires less wells than the number of vertical wells required to achieved the same sweep efficiency.

This improved process is especially useful in permafrost areas because the steam may be generated below the permafrost and near the points of injection and because a horizontal well provides more formation contact with less vertical well surface. This vastly reduces permafrost thawing over conventional surface steam generation and injection through the permafrost by multiple vertical wells.

DESCRIPTION OF THE DRAWING

The drawing is a schematic perspective view showing two laterally spaced drainhole wells in a subsurface viscous oil bearing formation wherein oil is produced in accordance with the teachings of this invention.

DESCRIPTION OF PREFERRED EMBODIMENTS

This invention provides a process for recovering viscous oil from a subsurface formation. The process combines known techniques in a manner such that overall sweep efficiency and heat utilization are increased and in a manner such that compression costs and well costs are reduced to the point that the process is economical for very low mobility oils. Increased sweep efficiency is accomplished by first creating fluid pressure communication between horizontal drainhole wells and producing oil during creation of fluid pressure commnication, and by true line drive between a horizontal drainhole injection well and a horizontal drainhole production well, and by the way heated oil drains into the horizontal wells. Increased heat utilization is accomplished by downhole hot fluid generation, by use of all of the heat produced, and by the way the down generated hot fluid and the products of combustion flow through the formation in an increased sweep pattern. Downhole hot fluid generation has the further advantage of permitting the generators to be used for gas lifting the formation fluids during production or backflowing cycles. Compression costs are decreased since the drive fluids are injected through less wells. Well costs are vastly reduced since two drainhole wells in line drive permits greater sweep efficiency with less wells than required for conventional vertical well techniques.

Accordingly, in the drawing there is shown drainhole wells 10 and 11 laterally spaced from each other and extending from earth surface 12 into viscous oil-bearing subsurface formation 13. The oil in formation 13 is shown trapped in conventional fashion by relatively impermeable underlying formation 14 and by relatively impermeable overlying formation 15. For illustrative purposes, overlying formation 15 is shown uplifted from oil-bearing formation 13. This invention is especially useful in remote permafrost areas; therefore, overlying formation 15 is shown overlain by permafrost 16.

Drainhole wells have wellbores that deviate from a generally vertically oriented wellbore toward a more generally horizontal direction. Accordingly, drainhole wells 10 and 11 have curved intervals 17 and 18 and horizontal intervals 19 and 20, respectively. Drainhole wellbores may include more than one curved and more than one horizontal interval deviating from the same vertical wellbore. Various drilling assemblies or systems have been proposed for developing and drilling drainhole wellbores. For example, U.S. Pat. No. 3,398,804 describes a drilling system comprised of knuckle joint sections, a reamer and a drill bit which are turned at the surface by way of a drill string. In this patent, the initial deflection and direction of curved build interval is controlled by a deflecting tool or whipstock which in combination with the knuckle joints and forces on the drilling assemblege causes the drill bit to cut into the wall of the vertical portion of the well, thereby tilting the common bit-reamer axis from the axis of the main borehole. As drilling is continued, the wellbore curves in the desired direction. Other types of drainhole drilling systems use downhole motors to turn the bit and reamer and bent subs or housings to generate the desired wellbore curvature. After the curved interval is completed, the drilling equipment is changed to drill a more stabilized interval generally horizontally oriented in oil-bearing formation 13. Drainhole wells 10 and 11 have the same orientation and horizontal intervals 19, and 20 extend in the direction to form continuous laterally spaced generally parallel lines. Preferably, these horizontal intervals are near the bottom of the part of the formation to be produced. The horizontal intervals are usually cased and are perforated along the longitudinal axis of the horizontal interval. In this manner, injected into one well will flow in a line sweep pattern if there is fluid pressure communication between the horizontal intervals.

After the drainhole wells are completed into formation 13, fluid pressure communication is created between horizontal intervals 19 and 20 in any conventional manner that produces oil during at least a part of the time that fluid pressure communication is being created. Fluid pressure communication means that when elevated fluid pressure is exerted and sustained on the formation adjacent to one horizontal interval, the pressure in the other horizontal interval increases after a reasonable or practical period of of time if the second well is shut-in. Preferably, fluid pressure communicaiton between horizontal intervals 19 and 20 is created by steam huff and puff (including steam soak) techniques wherein steam is injected or passed into formation 13 through one or both horizontal intervals for a period of time. Thereafter steam injection is ceased. Hot water may be used if the viscous oil-bearing formation contains materials like clay that react with steam and damage the formation permeability. Otherwise steam is preferred. Fluids including oil are produced from the formation through the horizontal interval used to inject steam into the formation. These huff and puff steps are repeated until the fluid pressure communication is created. Horizontal drainhole wells have unique advantages for this purpose. The amount of oil produced by huff and puff is vastly increased and makes te process much more economical. In vertical wells the flow path is like a sliver and quickly closes. Horizontal drain intervals allow a sort of line sweep pattern to develop which extends laterally and horizontally opening a more permanent thicker and greater volume fluid pressure communication path.

After fluid pressure communicaiton has been created, the process of this invention utilizes downhole steam generation and hot fluid injection in horizontal line drive fashion between wells 10 and 11. Accordingly, in well 10 there is shown downhole hot fluid generator 21 which is located at a suitable downhole point, preferably near formation 13. A generator like that disclosed in U.S. Pat. No. 3,456,721 may be operated to generate hot water to superheated steam downhole. If formation 13 is in a permafrost area, downhole steam generation 21 will be located at a downhole point below permafrost 16. A combustion supporting gas (for example, air, oxygen or other oxygen-containing gases) and a suitable fuel (for example, natural gas, oil, residuum from a topping plant or other similar substance) are injected into well 10 down to hot fluid generator 21. Any desired pressure may be used which is suitable for the purposes hereinafter set forth. The fuel and combustion supporting gas are burned at the same time an aqueous fluid (for example, low quality steam, water, heated water or the like) is injected into well 10. The aqueous fluid quenches or heat exchanges with the flame and the aqueous fluid is converted to hot fluid (for example, superheated steam, high quality steam, steam and water, or hot water. Steam is much preferred due to its mobility and total heat-carrying properties, but hot water may be used if steam would damage the formation permeability. The hot aqueous fluid and hot products of combustion are passed at a pressure below the facturing pressure of formation 13 from the downhole hot fluid generation point directly into subsurface formation 13, thereby utilizing all of the heat. In remote areas, there is usually a surplus of natural gas. Natural gas and air are the much preferred fluids. Natural gas is an especially efficient fuel for downhole steam generators. This system uses approximately 60% of the fuel by volume needed by surface generators to obtain the same reservoir heating effect.

The hot fluids enter the formation and due to the fluid pressure communication previously created and the line drive sweep path between horizontal intervals 19 and 20 of wells 10 and 11, respectively, the hot fluids transfer heat to the inplace viscous oil reducing its viscosity and rendering it mobile. The products of combustion tend to rise in a horizontal layer reducing the viscosity and increasing the mobility of oil remaining in the upper part of formation 13. Steam tends to rise in a horizontal by oriented layer following sweep path 23 a the steam transfers heat to the inplace oil and condenses. The heated oil tends to flow and drain downward and toward horizontal interval 20 of well 11 in a horizontal layer following sweep path 24 to horizontal interval 20 where the oil is produced to surface 12. Conventionally, the oil is produced by pumping. But in this invention, downhole hot fluid generators may be placed in both drainhole wells 10 and 11 in formation 13 and the generators may be operated to produce steam for gas lifting or assisting pumping of the oil to the surface. Steam has the further advantage of preventing wax deposition. All of this is made possible only because fluid pressure communication has been previously created and the drain wells are horizontally oriented.

It is preferred that the downhole steam generator be used to also generate the steam for the hot aqueous fluid huff and puff steps used to create fluid pressure communication between the horizontal intervals of wells 10 and 11. As previously mentioned, a downhole steam generator (not shown) may also be placed downhole in well 11. In addition, hot aqueous fluid drive and production may be switched periodically between wells 10 and 11 if desired.

Various embodiments and modifications of this invention hae been described in the foregoing description and examples, and further modifications will be apparent to those skilled in the art (for example, a series or pattern of drainhole wells may be employed). Such modifications are included within the scope of this invention as defined by the following claims.

I claim:

1. A method for producing oil from an oil-bearing subsurface formation comprising:

(a) completing a first drainhole well wherein said first well has a horizontal interval extending into said formation from a vertical wellbore;

(b) completing a second drainhole well wherein said second well has a horizontal interval extending into said formation from a vertical wellbore, said first and second drainhole wells being spaced from each other with said horizontal intervals extending in the same direction and orientation and at substantially at the same depth whereby said horizontal intervals are parallel to each other in substantially the same horizontal plane;

(c) creating fluid pressure communication between said horizontal intervals of said first and second drainhole wells;

(d) producing oil from said formation during at least a part of step (a);

(e) injecting a combustion supporting gas, fuel and aqueous fluid into said first well;

(f) burning injected fuel downhole in said first well at a downhole point in a manner such that aqueous fluid injected into said first well is converted to hot aqueous fluid;

(g) passing the products of combustion and said hot aqueous fluid downward from the said downhole point directly into said horizontal interval to establish a horizontal line drive through the formation from said first well toward said second well; and (h) producing oil from said second well.

2. The method of claim 1 wherein in step (f) said hot aqueous fluid is steam.

3. The method of claim 1 wherein in step (e) said combustion gas is air and said fuel is natural gas.

4. The method of claim 3 wherein in step (f) said hot aqueous fluid is steam.

5. The method of claim 1 wherein said first of second wells are completed through permafrost and said downhole point is below said permafrost.

6. The method of claim 5 wherein in step (f) said hot aqueous fluid is steam.

7. The method of claim 5 wherein in step (e) said combustion gas is air and said fuel is natural gas.

8. The method of claim 7 wherein in step (f) said hot aqueous fluid is steam.

9. The method of claim 1 wherein in step (c) fluid pressure communication is created by sequentially injecting hot aqueous fluid into said formation by way of one of said wells for a period of time, ceasing injection of not aqueous fluid, producing fluids from said formation through said well, and repeating said sequence until said fluid pressure communication is created.

10. The method of claim 9 wherein in step (e) said combustion gas is air and said fuel is natural gas.

11. The method of claim 10 wherein in steps (c) and (d) said hot aqueous fluid is steam.

12. The method of claim 10 wherein said first of second wells are completed through permafrost and said downhole point is below said permafrost.

13. The method of claim 12 wherein in step (e) said combustion gas is air and said fuel is natural gas.

14. The method of claim 13 wherein in steps (c) and (d) said hot aqueous fluid is steam.

15. The method of claim 9 wherein said first of second wells are completed through permafrost and said downhole point is below said permafrost.

16. The method of claim 15 wherein in step (e) said combustion gas is air and said fuel is natural gas.

17. The method of claim 16 wherein in step (f) said hot aqueous fluid is steam.

18. The method of claim 1 wherein in step (c) fluid pressure communication is created by sequentially injecting steam into said formation by way of both said wells for a period of time, ceasing injection of steam, producing fluids from said formation through both of said wells, and repeating said sequence until said fluid pressure communication is created.

19. The method of claim 18 wherein in step (e) said combustion gas is air and said fuel is natural gas.

20. The method of claim 14 wherein in steps (c) and (d) said hot aqueous fluid is steam.

* * * * *